US005379948A

United States Patent [19]

Teppo

[11] Patent Number: 5,379,948

[45] Date of Patent: Jan. 10, 1995

[54] METHOD FOR MILLING CLAY WITHOUT SUBSTANTIAL GENERATION OF POWDER

[75] Inventor: Maynard Teppo, Belle Fourche, S. Dak.

[73] Assignee: American Colloid Company, Arlington Heights, Ill.

[21] Appl. No.: 177,938

[22] Filed: Jan. 6, 1994

[51] Int. Cl.[6] ..... B02C 23/14

[52] U.S. Cl. ..... 241/24; 241/23; 241/29

[58] Field of Search ..... 241/23, 24, 76–81, 241/293, 159, 29

[56] References Cited

U.S. PATENT DOCUMENTS

| | | | |
|---|---|---|---|
| 160,618 | 3/1875 | Rudy | 241/76 |
| 440,480 | 11/1890 | Kruger | 241/159 X |
| 2,182,131 | 12/1939 | Marde | 241/76 X |
| 2,223,468 | 12/1940 | Spencer | 241/76 |
| 2,343,270 | 3/1944 | Agnew | 241/76 X |
| 5,050,808 | 9/1991 | Satake et al. | 241/159 X |

FOREIGN PATENT DOCUMENTS

| | | | |
|---|---|---|---|
| 621942 | 5/1927 | France | 241/76 |

*Primary Examiner*—Timothy V. Eley
*Attorney, Agent, or Firm*—Marshall, O'Toole, Gerstein, Murray & Borun

[57] ABSTRACT

An apparatus and method for crushing clay to reduce the size of the clay to a uniform particle size distribution without generating a substantial percentage of undersized particles. Oversized clay particles are fed to a first roller mill between a first pair of counter-rotating, adjacent, grooved rollers. The particles exiting the first roller mill that have the desired particle size distribution are separated from the undersized and oversized clay particles exiting the first roller mill, prior to crushing the oversized particles in a second roller mill. The oversized particles from the first roller mill then are fed to the second roller mill between a second pair of counter-rotating, adjacent rollers that are separated by a roller gap that is smaller than a roller gap of the first roller mill. By providing grooves in the outer surfaces of at least the first pair of rollers, in the first roller mill, and by removing the on-size particles prior to sending the over-size particles to the second roller mill, about 85% to about 95% of the clay feed is crushed to the desired particle size. It should be noted that the particle size distribution is set between a top screen and bottom screen, the product being recovered between the two screens, and the particle size distribution can be fixed by adjusting the roller gap between the rollers of one or more roller mills of the apparatus to achieve a specified particle size distribution.

14 Claims, 2 Drawing Sheets

METHOD FOR MILLING CLAY WITHOUT SUBSTANTIAL GENERATION OF POWDER

FIELD OF THE INVENTION

The present invention is directed to an apparatus and method for sizing solid, particulate material, such as clay, into particles having a desired particle size distribution, for example, clay having a particle size smaller than 25 mesh (U.S. Sieve Series) and larger than 60 mesh, U.S. Sieve Series, without generating a substantial quantity of fines or powder material, to achieve an overall yield of at least about 85%, preferably at least about 90% by weight. More particularly, the present invention is directed to a crushing apparatus and method for crushing clay between a plurality of sets of rollers wherein a second milling stage includes a pair of rollers that have smooth surfaces or, preferably, having grooves of smaller width, that are spaced less than the previous roller set.

BACKGROUND OF THE INVENTION AND PRIOR ART

Clays are mined from the earth in a wet condition, containing about 15% to about 35% by weight water, and must be dried and crushed to a desired particle size distribution before being useful in essentially any of the industries in which clays are used. The milling or crushing process of the present invention is useful for any clay that requires a reduction in particle size to make that clay useful for a particular purpose. While the process of the present invention is particularly useful for crushing a smectite clay, it is also useful for kaolin clay; serpentines; talc and pyrophyllite; illite; glauconite; chlorite and vermiculite; palygorslite and sepiolite; allophane and imogolite; diaspore clay; boehmite; and mixtures thereof. The preferred smectite clays milled in accordance with the principles of the present invention include montmorillonite; beidellite; nontronite; hectorite; saponite; sauconite; and mixtures thereof.

In the milling or crushing of any of the above-mentioned clays to prepare the clay for an industrial use, it is desirable to minimize the amount of very fine or powdery clay particles produced in the crushing process. Very fine, powdery clay particles are undesirable due to their dusting characteristics, presenting environmental problems in the plant and, for most industrial uses, the fine, powdery clay particles are not useful. Prior art milling processes for grinding clay to a desired particle size, such as a clay particle size distribution between about 250 microns and 707 microns (plus 25, minus 60 mesh, U.S. Sieve Series) result in ground particles that include about 30% by weight fines or powder (having a particle size less than about 250 microns) that must be discarded or otherwise processed, such as by pelletizing or otherwise granulating the fine particles, so that they can be reground to a useful particle size. Extant milling processes for grinding clay to a desired particle size distribution achieve only about a 70% yield (30% of the clay feed to the milling process is ground into fines or powder having a size less than about 250 microns and must be further treated to increase the particle size to make this portion of the clay useful).

In accordance with the principles of the present invention, an apparatus and method for milling or crushing clay has been discovered that surprisingly provides a yield of about 85% to about 95% by weight, usually about 90% to about 95% by weight yield, so that only about 5% to about 15% by weight of the clay feed to the apparatus, usually about 5% to about 10% by weight, need be discarded or granulated.

SUMMARY OF THE INVENTION

In brief, the present invention is directed to an apparatus and method for crushing clay to reduce the size of the clay to a uniform particle size distribution without generating a substantial percentage of undersized particles. In accordance with the present invention, oversized clay particles are fed to a first roller mill between a first pair of counter-rotating, adjacent, grooved rollers. The particles exiting the first roller mill that have the desired particle size distribution are separated from the undersized and oversized clay particles exiting the first roller mill, prior to grinding the oversized particles in a second roller mill. The oversized particles from the first roller mill then are fed to the second roller mill between a second pair of counter-rotating, adjacent rollers that are separated by a roller gap that is smaller than a roller gap of the first roller mill.

Surprisingly, by providing grooves in the outer surfaces of at least the first pair of rollers, in the first roller mill, and by removing the on-size particles prior to sending the over-size particles to the second roller mill, about 85% to about 95% of the clay feed is ground to the desired particle size distribution, usually about 90% to about 95% by weight. Surprisingly, substantially less powder or fine material is produced in the crushing process and apparatus of the present invention.

The number of grooves and width of each groove in the rollers of the first, and optionally the second roller mill, can be varied to provide a milled clay product having essentially any desired particle size distribution. The spacing between adjacent rollers in each roller mill also can be easily adjusted to provide essentially any desired particle size distribution for the clay product, while producing substantially less fine or powdery clay material. Additional third, fourth and subsequent roller mills can be provided for additional crushing of any oversize particles exiting the second roller mill, wherein the rollers of the subsequent roller mills can include grooves or can have smooth surfaces. Alternatively, over-size particles from the second, third or other subsequent roller mills can be recycled to one or more previous roller mills for crushing the over-size clay particles.

Accordingly, one aspect of the present invention is to provide a method of milling clay to reduce the size of the clay to a uniform particle size distribution without generating a substantial percentage of undersized particles, particularly particles having a particle size less than about 250 microns.

Another aspect of the present invention is to provide a method of crushing clay, particularly smectite clay, such as sodium bentonite, by crushing the clay through a plurality of successively arranged roller mills wherein the outer surfaces of at least the first pair of rollers of the first roller mill includes a plurality of adjacent, parallel grooves for reducing the percentage of fine or powdery clay produced in the roller mills.

Another aspect of the present invention is to provide a method of crushing clay to reduce the size of the clay to a uniform particle size distribution, without generating a substantial percentage of powdered clay, by feeding the clay through a plurality of successively disposed roller mills, each comprising a pair of adjacent rollers, wherein an outer surface of both rollers of the first roller mill are grooved, and on-size particles are removed prior to directing the over-size particles to the second roller mill.

Another aspect of the present invention is to provide a method of milling clay to reduce the size of the clay to a uniform particle size distribution wherein a plurality of roller mills each include a pair of grooved rollers rotating at different speeds to pull the clay through the roller gap and cut the clay particles to the desired size.

The above and other aspects and advantages of the present invention will become more apparent from the following detailed description of the present invention taken in conjunction with the drawings.

DETAILED DESCRIPTION OF THE PREFERRED EMBODIMENT

Clay is mined in a wet condition, generally about 15% to about 35% by weight water, based on the dry weight of the clay, and, for efficient milling or crushing, the clay should be dried to a water content below about 15% by weight, preferably in the range of about 5% to about 10–12% by weight water, based on the dry weight of the clay. Once dried to a suitable moisture content for crushing purposes, the clay then is milled in accordance with the present invention to provide a crushing clay product having a uniform particle size distribution while, surprisingly, producing less than about 15% by weight, preferably less than about 10% by weight fines or powdery clay particles.

Figure 1:
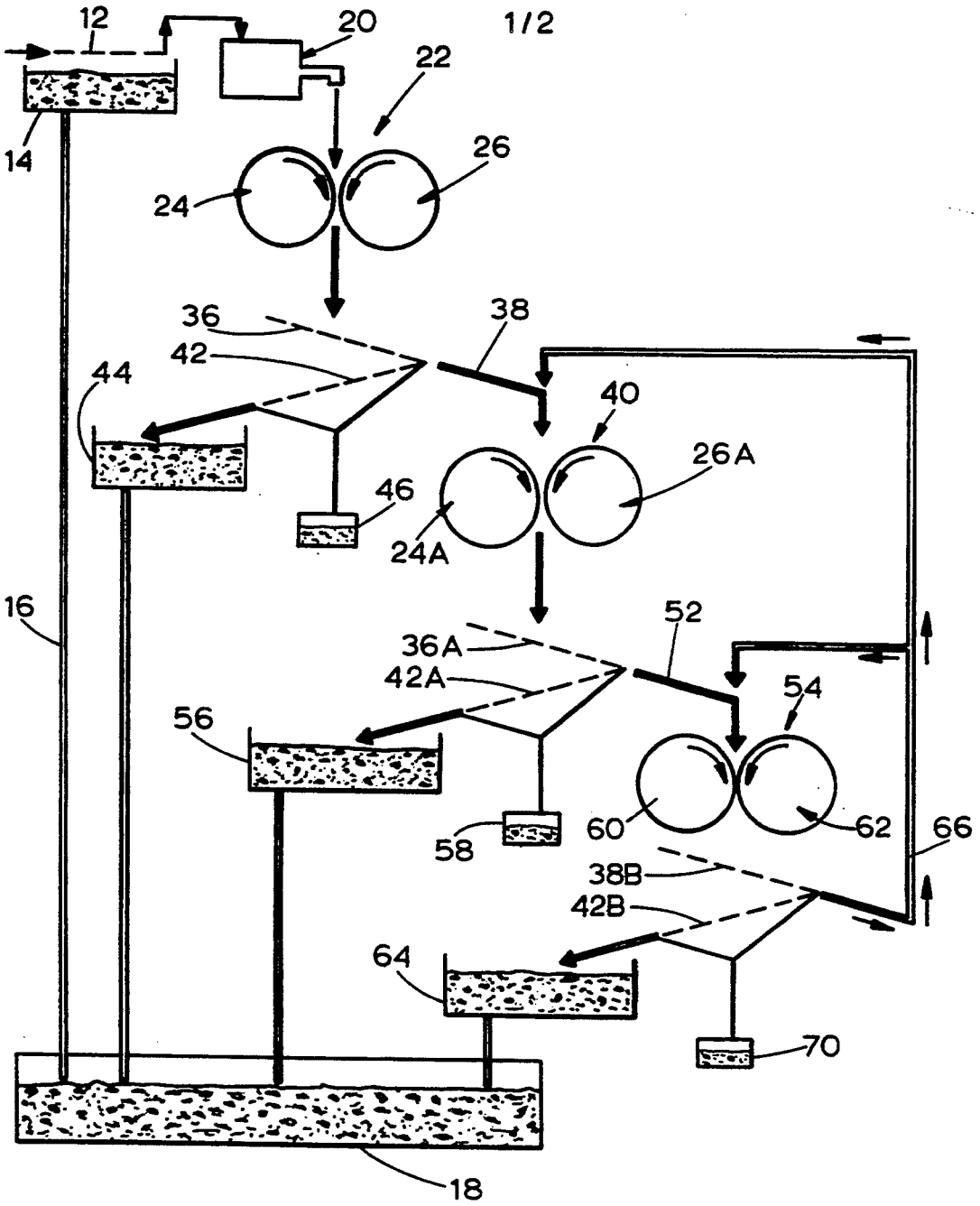
FIG. 1 is a schematic diagram of the preferred method and apparatus of the present invention.

Turning now to the drawings, and initially to FIG. 1, after a crude clay has been mined and dried to a suitable moisture content for crushing, the dried clay preferably is fed over a scalping screen 12 to first remove rocks and any clay particles that already have the desired particle size as a result of the attrition of the drying process. The clay particles that pass through the scalping screen 12, that have the desired particle size, are collected in product hopper 14 and conveyed along conduit 16, or otherwise, to a product collection hopper 18. The over-size clay particles are conveyed to a clay feeder 20 that feeds the clay to a first roller mill, generally designated by reference numeral 22, between a pair of adjacent, counter-rotating, grooved rollers 24 and 26.

Figure 2:
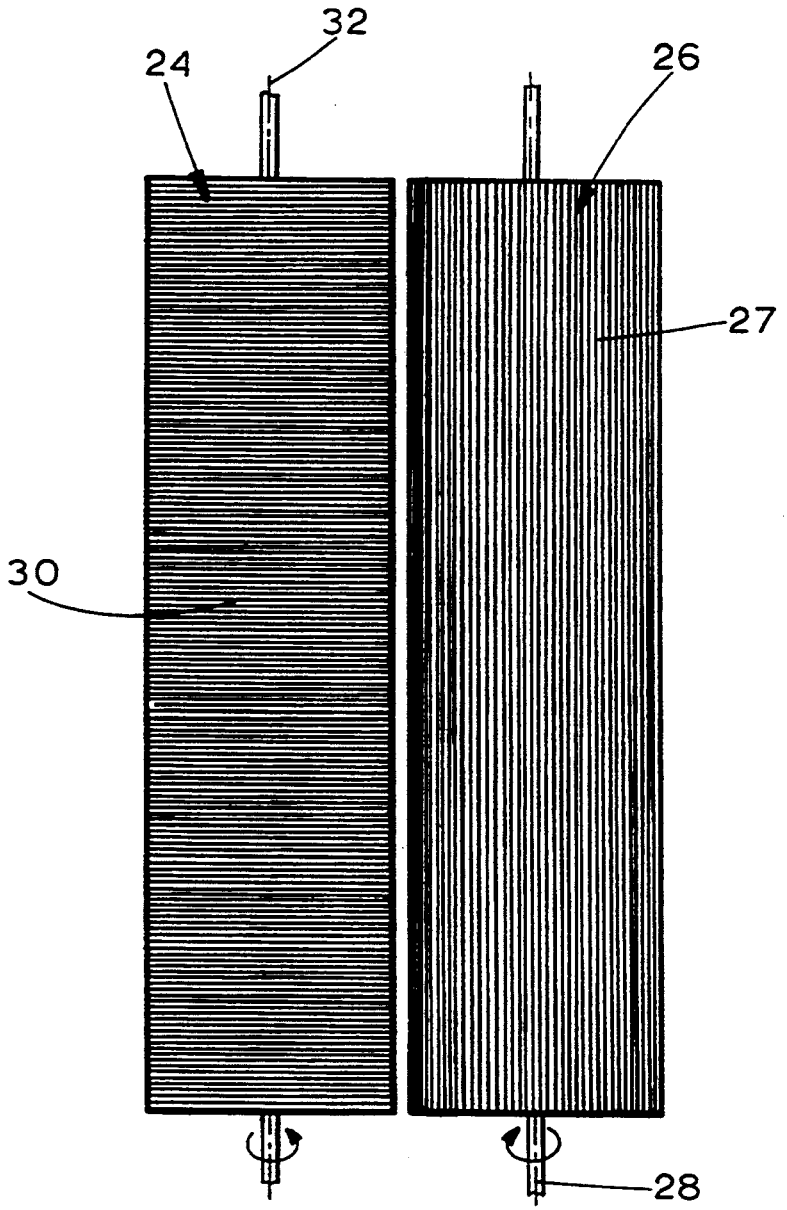
FIG. 2 is a top view of the grooved, adjacent rollers that form the first and, optionally, subsequent roller mills of the apparatus and method of the present invention.

The preferred rollers 24 and 26, best shown in FIG. 2, each include a plurality of parallel grooves in its outer surface. In the preferred embodiment, rollers 24 and 26 are 32 La-Page rollers having a diameter of 12 inches, a length of 52 inches, and include 32 grooves per inch of surface, or a total of about 1206 grooves for roller 26 and about 1664 grooves for roller 24. One of the rollers 26 includes horizontal grooves parallel to a longitudinal axis 28 of roller 26, and the other roller 24 includes a plurality of parallel, annular grooves 30, each groove disposed in a plane that is perpendicular to a longitudinal axis 32 of roller 24. In the preferred method of the present invention for crushing clay to a particle size distribution between about 25 mesh and about 60 mesh, U.S. Sieve Series (250 microns to 707 microns) rollers 24 and 26 are spaced about 10–20 mils apart at a nip (a space between the rollers, along the full length of adjacent rollers, where the adjacent rollers are closest together). In another embodiment, to achieve a granular product having a particle size distribution between 14 mesh and 40 mesh (U.S. Sieve Series), 420 microns to 1410 microns, rollers 24 and 26 are 8 La-Page rollers, having 8 grooves per inch; a second roller mill has rollers each including 16 grooves per inch; and a third roller mill has rollers each including 32 grooves per inch. The gap spacing between the rollers of each roller mill again will be narrower in the second roller mill than in the first roller mill by about 40% to about 60%, and the gap spacing between rollers in the third roller mill will be about 40% to about 60% narrower than the gap spacing in the second roller mill. In this manner, a proportional amount of on-size particles is obtained, e.g., one third, from each of the three roller mills without much fines resulting.

Rollers 24 and 26 are counter-rotating, as indicated by the arrows in FIGS. 1 and 2, to pull the clay between the rollers and to crush the clay therebetween. In accordance with the method and apparatus of the present invention, rollers 24 and 26 of the first roller mill 22 are rotated so that there is a rotating speed differential between the two rollers 24 and 26. For example, in the preferred mode of operation, roller 26 is rotated at a speed of 750 revolutions per minute while roller 24 is rotated at a speed of 500 revolutions per minute. The roller 26, having horizontal grooves, should be rotated at the greater rate of speed to pull the clay through roller nip and cut the clay to a desired particle size. In this manner, a surprisingly small percentage of fine particles are generated in accordance with the principles of the present invention. There is no grinding action, as such, in the roller mills having grooved rollers, only a squeezing and crushing action.

The ground clay exiting the first roller mill 22 then is separated into on-size, under-size, and over-size particles, such as by screening. As shown in FIG. 1, to produce particles having a 25 to 60 mesh particle size distribution, the crushed particles exiting the first roller mill 22 are first passed over a 25 mesh, inclined screen 36. The over-size particles that do not pass through the inclined screen 36 flow downwardly, over the upper surface of the screen 36 through a conveying mechanism 38 for delivery to a second roller mill, generally designated by reference numeral 40. Clay particles that pass through the inclined screen 36 fall onto an inclined 60 mesh screen 42 that retains all clay particles having a particle size distribution between 25 mesh and 60 mesh. This product falls downwardly by gravity, or is otherwise conveyed into product hopper 44. The undersize fine or powdery clay particles pass through the 60 mesh screen 42 and fall into a first by-product or under-size particle hopper 46. The particle size distribution, e.g., between 25 mesh and 60 mesh, can be changed so a higher percentage can be moved from the small to larger particle size, or vice versa, within the 25 to 60 mesh product. For example, if the product desired includes about 45% by weight particles between 25 mesh and 40 mesh, and about 45% to about 50% by weight between about 50 mesh and 60 mesh, the roller gaps in at least the first roller mill, and preferably in the first two roller mills, can be adjusted (wider for larger particles and narrower for smaller particles) to achieve the desired particle size distribution.

It has been found that it is important to remove the on-size particles from the first roller mill 22 before further crushing the clay in a succeeding roller mill for the purpose of minimizing the total amount of under-size particles generated in the crushing process. If the clay particles are subjected to succeeding roller mills without an intermediate on-size particle removal step, a substantially greater amount of fine particles (about 10% to about 25% by weight more fines) are generated in the crushing process.

The over-size particles that are retained on the upper surface of the 25 mesh screen 36, and conveyed to the second roller mill 40, are crushed to further reduce their particle size, using smooth or grooved rollers 24A and 26A of second roller mill 40, that can be essentially the same as rollers 24 and 26, but preferably, if grooved, having narrower grooves than rollers 24 and 26. In the preferred embodiment, rollers 24A and 26A are smooth-surfaced rollers. Alternatively, the second roller mill 40 can be formed from rollers having grooved outer surfaces, identical to rollers 24 and 26, or preferably having a greater number of grooves in rollers 24A and 26A. In accordance with an important feature of the present invention, rollers 24A and 26A, that form the second roller mill 40, whether smooth or grooved, are spaced more closely together at their nip than the rollers 24 and 26 that form the first roller mill 22.

In accordance with the preferred embodiment shown in FIG. 1, for producing a product having a particle size distribution between about 25 mesh and about 60 mesh (U.S. Sieve Series), rollers 24A and 26A of the second roller mill 40 are spaced a distance of 1–10 mils for most efficient crushing of clay to produce a product having the 25 to 60 mesh particle size distribution. Like the first roller mill 22, the second roller mill 40 operates with the two rollers 24A and 26A rotating at different speeds, with the horizontally grooved roller 26A rotating faster than the annular-grooved roller 24A. To achieve the full advantage of the present invention, rollers 26 and 26A rotate at a speed of 750 revolutions per minute and rollers 24 and 24A rotate at a speed of 500 revolutions per minute.

In accordance with another important feature of the present invention, rollers 24A and 26A, forming the second roller mill 40, if grooved, have grooves that have a smaller width than the grooves in the rollers 24 and 26 of the first roller mill 22. The width of the grooves of rollers 24A and 26A of the second roller mill 40, to achieve the full advantage of the present invention, should be about 40% to about 60% narrower, preferably about 50% narrower than the width of the grooves in the outer surfaces of rollers 24 and 26 of the first roller mill 22 to provide the most efficient crushing process with the least generation of fines or powdery clay particles.

The crushed clay particles exiting the second roller mill 40 again are separated into on-size, over-size and under-size particles, such as in a screening apparatus similar to that described above with reference to treating the crushed clay particles exiting the first roller mill 22. As shown in FIG. 1, the clay particles from the second roller mill 40 fall onto an inclined 25 mesh screen 36A, which retains the over-size particles. The over-size particles fall downwardly over the inclined 25 mesh screen 36A and are, optionally, conveyed via conduit or conveying apparatus 52 to a third roller mill 54. Clay particles that pass through the inclined 25 mesh screen 36A fall onto an upper surface of 60 mesh screen 42A for collection in a product hopper 56. Under-size fine or powdery particles that pass through the 60 mesh screen 42A are collected in a by-product or powder hopper 58.

The over-size particles exiting the second roller mill 40 preferably, but optionally, are again crushed in third roller mill 54 that includes rollers 60 and 62 having smooth, non-grooved outer surfaces and have a roller nip spacing about 40–60% narrower than the nip spacing of the rollers 24A and 26A, e.g., 1–5 mils. The crushed clay particles that exit the third roller mill 54 again are separated into on-size, undersize and over-size particles, in the same manner described above, using an inclined 25 mesh screen 36B, and an inclined 60 mesh screen 42B. The on-size 25–60 mesh product particles are recovered from an upper surface of 60 mesh screen 42B and collected in product hopper 64. The over-size particles from an upper surface of 25 mesh screen 36B can be conveyed to another crushing apparatus or, preferably, are recycled via conveying apparatus 66 to the second roller mill 40 or third roller mill 54 to crush the over-size particles into on-size particles and a small amount of under-size particles. The under-size particles that pass through 60 mesh screen 42B are collected in undersize, fine particle by-product hopper 70. The on-size particles from all three roller mills 22, 40 and 54 are conveyed from product hoppers 44, 56 and 64 into the product collection hopper 18 for packaging, or transport in bulk.

It should be understood that while the above-described apparatus and process have been described in particularity with respect to the manufacture of a clay particle product having a particle size distribution in the range of 25 mesh to 60 mesh (U.S. Sieve Series). By varying the width of the grooves in the roller mill rollers and by varying the spacing at the nip between the roller mill rollers, the above-described apparatus and method are useful to produce clay particles having any desired particle size distribution while producing substantially less fine or under-size particles.

What is claimed is:

1. A method of crushing clay to reduce the size of the clay to a desired particle size distribution, without generating a substantial percentage of under-size particles, comprising the steps of:

feeding clay particles to a first roller mill between a first pair of counter-rotating, adjacent rollers rotating at different speeds, each having a plurality of parallel grooves in an outer surface thereof, said pair of grooved rollers being separated by a first roller gap, such that the clay particles exiting the gap are smaller than the clay particles fed between the first pair of rollers;

separating on-size particles exiting the first roller mill, that have the desired particle size distribution, from under-size and over-size clay particles exiting the first roller mill, before feeding the over-size particles to a second roller mill;

feeding the over-size particles from said first roller mill to a second roller mill between a second pair of counter-rotating, adjacent rollers that are separated by a second roller gap that is smaller than said first roller gap; and separating on-size particles exiting the second roller gap, that have the desired particle size distribution, from under-size and over-size clay particles exiting the second roller gap.

2. A method as recited in claim 1, wherein the first roller mill comprises one roller that includes a plurality of grooves disposed in an outer surface thereof, each groove parallel to a longitudinal axis of the roller; and another roller that includes a plurality of annular grooves in an outer surface thereof; each annular groove encircling the longitudinal axis of the roller; and wherein the second roller mill comprises one roller that includes a plurality of grooves disposed in an outer surface thereof, each groove parallel to a longitudinal axis of the roller; and another roller that includes a plurality of annular grooves in an outer surface thereof; each annular groove encircling the longitudinal axis of the roller.

3. A method as recited in claim 1, wherein the first roller mill comprises one roller that includes a plurality of grooves disposed in an outer surface thereof, each groove parallel to a longitudinal axis of the roller; and another roller that includes a plurality of annular grooves in an outer surface thereof; each annular groove encircling the longitudinal axis of the roller; and wherein the second roller mill comprises two adjacent rollers having smooth, non-grooved outer surfaces.

4. A method as recited in claim 1, further including the step of drying the clay, prior to feeding said clay between the first pair of rollers, to a moisture content less than about 15% by weight, based on the dry weight of the clay.

5. A method as recited in claim 4, further including the step of drying the clay, prior to feeding said clay between the first pair of rollers, to a moisture content of about 5% to about 10% by weight, based on the dry weight of the clay.

6. A method as recited in claim 1, wherein the clay is a smectite clay.

7. A method as recited in claim 6, wherein the smectite clay is selected from the group consisting of sodium bentonite, calcium bentonite, and mixtures thereof.

8. A method as recited in claim 1, further including the step of screening the clay exiting each pair of rollers to separate the clay into particles having the desired particle size distribution; under-size particles; and over-size particles.

9. A method as recited in claim 1, wherein the desired particle size distribution is 10 to 60 mesh, U.S. Sieve Series.

10. A method of crushing clay to reduce the size of the clay to a desired particle size distribution, without generating a substantial percentage of under-size particles, comprising the steps of:

feeding clay particles to a first roller mill between a first pair of counter-rotating, adjacent rollers rotating at different speeds, each having a plurality of parallel grooves in an outer surface thereof, said pair of grooved rollers being separated by a first roller gap, such that a majority of the clay particles exiting the gap are smaller than the clay particles fed between the first pair of rollers;

separating on-size particles exiting the first roller mill, that have the desired particle size distribution, from under-size and over-size clay particles exiting the first roller mill, before feeding the over-size particles to a second roller mill;

feeding the over-size particles from said first roller mill to a second roller mill between a second pair of counter-rotating, adjacent grooved rollers that are separated by a second roller gap that is smaller than said first roller gap;

both of said rollers of said first roller mill and both of said rollers of said second roller mill including spaced grooves in an outer surface thereof, said grooved rollers of said first roller mill having grooves that are wider than the grooves in the grooved rollers of said second roller mill;

separating on-size particles exiting the second roller gap, that have the desired particle size distribution, from under-size and over-size clay particles exiting the second roller mill, before feeding the over-size particles to a third roller mill;

feeding the over-size particles from said second roller mill to a third roller mill between a third pair of counter-rotating rollers;

separating on-size particles exiting the third roller mill, that have the desired particle size distribution, from under-size and over-size clay particles exiting the third roller mill, before reducing the particle size of the over-size particles exiting the third roller mill; and reducing the particle size of over-size particles from said third roller mill.

11. A method as recited in claim 10, wherein the first roller mill comprises one roller that includes a plurality of grooves disposed in an outer surface thereof, each groove parallel to a longitudinal axis of the roller; and another roller that includes a plurality of annular grooves in an outer surface thereof; each annular groove encircling the longitudinal axis of the roller; and wherein the second roller mill comprises one roller that includes a plurality of grooves disposed in an outer surface thereof, each groove parallel to a longitudinal axis of the roller; and another roller that includes a plurality of annular grooves in an outer surface thereof; each annular groove encircling the longitudinal axis of the roller.

12. A method as recited in claim 11, wherein the third pair of counter-rotating rollers have smooth, non-grooved outer surfaces.

13. A continuous method of crushing clay to reduce the size of the clay to a desired particle size distribution, without generating a substantial percentage of under-size particles, comprising the steps of:

feeding clay particles to a first roller mill between a first pair of counter-rotating, adjacent rollers rotating at different speeds, each having a plurality of parallel grooves in an outer surface thereof, said pair of grooved rollers being separated by a first roller gap, such that the clay particles exiting the gap are smaller than the clay particles fed between the first pair of rollers;

separating on-size particles exiting the first roller mill, that have the desired particle size distribution, from under-size and over-size clay particles exiting the first roller mill, before feeding the over-size particles to a second roller mill;

feeding the over-size particles from said first roller mill to a second roller mill between a second pair of counter-rotating, adjacent rollers, rotating at different speeds, said second pair of rollers being separated by a second roller gap that is smaller than said first roller gap;

separating on-size particles exiting the second roller mill, that have the desired particle size distribution, from under-size and over-size clay particles exiting the second roller mill, before feeding the over-size particles to a third roller mill;

feeding the over-size particles from said second roller mill to a third pair of counter-rotating rollers;

separating on-size particles exiting the third roller mill, that have the desired particle size distribution, from under-size and over-size clay particles exiting the third roller mill, before recycling the over-size particles; and recycling the over-size particles from said third roller mill, to the first or second roller mill such that less than 15% by weight of the clay particles from all three roller mills are under-size.

14. A method as recited in claim 13, wherein the first roller mill comprises one roller that includes a plurality of grooves disposed in an outer surface thereof, each groove parallel to a longitudinal axis of the roller; and another roller that includes a plurality of annular grooves in an outer surface thereof; each annular groove encircling the longitudinal axis of the roller; and wherein the second roller mill comprises one roller that includes a plurality of grooves disposed in an outer surface thereof, each groove parallel to a longitudinal axis of the roller; and another roller that includes a plurality of annular grooves in an outer surface thereof; each annular groove encircling the longitudinal axis of the roller.

* * * * *